US006758594B2

(12) United States Patent
Yang

(10) Patent No.: US 6,758,594 B2
(45) Date of Patent: Jul. 6, 2004

(54) WRIST BAND AND WRIST WATCH

(75) Inventor: Thomas Yang, Elmhurst, NY (US)

(73) Assignee: Stanley Schleger, North Hills, NY (US)

( * ) Notice: Subject to any disclaimer, the term of this patent is extended or adjusted under 35 U.S.C. 154(b) by 226 days.

(21) Appl. No.: 09/997,648

(22) Filed: Nov. 29, 2001

(65) Prior Publication Data

US 2003/0099163 A1 May 29, 2003

(51) Int. Cl.[7] ..... G04B 37/00; A44C 5/00
(52) U.S. Cl. ..... 368/282; 368/281; 63/21
(58) Field of Search ..... 368/281, 282; 63/3, 21; 2/123; 224/171

(56) References Cited

U.S. PATENT DOCUMENTS

| | | | | |
|---|---|---|---|---|
| 2,482,660 A | | 9/1949 | Dewey | |
| 2,840,286 A | | 6/1958 | Schermerhorn | |
| 4,897,826 A | | 1/1990 | Rigberg et al. | |
| 5,035,000 A | * | 7/1991 | Matthias | 2/123 |
| 5,214,940 A | * | 6/1993 | Capifali | 63/21 |
| D339,072 S | | 9/1993 | Peckham et al. | |
| D394,394 S | | 5/1998 | Bruce et al. | |
| D401,511 S | | 11/1998 | Le Marquand | |
| D402,209 S | | 12/1998 | Papiernik | |
| 5,912,865 A | * | 6/1999 | Ortega | 368/276 |
| D414,430 S | | 9/1999 | Ortega | |

FOREIGN PATENT DOCUMENTS

| | | | | |
|---|---|---|---|---|
| CH | 648177 G | * | 3/1985 | 368/282 |
| DE | 4029233 A1 | * | 3/1992 | 368/282 |

* cited by examiner

*Primary Examiner*—Randy W. Gibson
*Assistant Examiner*—Jeanne-Marguerite Goodwin
(74) *Attorney, Agent, or Firm*—Ostrolenk, Faber, Gerb & Soffen, LLP

(57) ABSTRACT

A wrist band comprising a band for the wrist having a major longitudinal axis along a substantial portion of the length of the band and having two ends, the two ends each having a minor axis which is disposed at an angle to the major longitudinal axes, the ends further forming a substantially perpendicular intersection with the minor axes, the band being adapted to connect to an object to be attached between the ends to be worn at the wrist, whereby the angle between the minor axes at the ends is less than 180°. In another embodiment, the band has an approximate frusto-conical shape when worn.

17 Claims, 4 Drawing Sheets

WRIST BAND AND WRIST WATCH

BACKGROUND OF THE INVENTION

The present invention relates to wrist bands and particularly to wrist bands which are adapted to hold, for example, wrist watches or other items, for example, items of jewelry.

An aim of the invention is to provide a wrist band, for example, for a wrist watch, which allows the watch or other items to be maintained in position on the wrist due to the anatomical curvature of the wrist, whereby the watch is easily readable. It is further an object of the present invention to provide a wrist band which can be disposed beneath a shirt sleeve, but which allows the watch to be exposed beyond the shirt sleeve for easy reading.

Various wrist watches are known including U.S. Des. Pat. No. 402,209, 398,394, 445,041, 339,072, U.S. Pat. No. 2,482,660, 2,840,286, 4,897,826, U.S. Des. Pat. No. 414,430 and U.S. Des. Pat. No. 401,511.

However, none of these designs succeed in providing a wrist band which is particularly useful for a wrist watch, which meets the above objectives.

Accordingly, it is an object of the present invention to provide a wrist band which can be used with a wrist watch for allowing the watch to be exposed on the wearer's wrist in a position such that the watch is easily readable. It is further an object of the present invention to provide such a wrist band which maintains the watch in position on the wrist due to the anatomical curvatures of the wrist for easy viewing. It is furthermore an object of the invention to provide a wrist band that can be worn hidden under a long sleeve but which allows the watch or other item to be exposed beyond the sleeve. It is furthermore an object of the invention to provide a more comfortable band and wrist watch.

The above and other objects of the present invention are achieved by a wrist band comprising:

a band for securement around the wrist of a wearer, the band having two ends, the band having a major longitudinal axis substantially extending over a major length of the band, the band being disposed at an angle to the major longitudinal axis of the band at ends of the band as defined by minor axes at the ends, the ends of the band further forming a substantially perpedicular intersection with the minor axes where the band attaches to an object to be attached between the ends of the band.

According to a preferred embodiment of the invention, the object comprises a wrist watch.

According to another aspect, the band, when worn, has an approximately frusto-conical shape.

Other objects features and advantages of the present invention will become apparent from the detailed description as follows.

BRIEF DESCRIPTION OF THE DRAWINGS

The invention will now be described in greater detail in the following detailed description in which.

DETAILED DESCRIPTION OF EMBODIMENTS OF THE INVENTION

Figure 1:
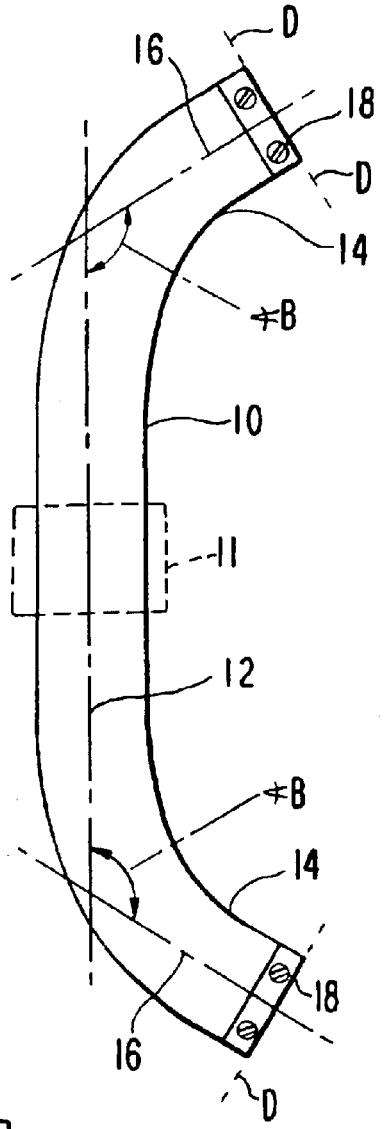
FIG. 1 shows a first embodiment of the invention.
Figure 2A:
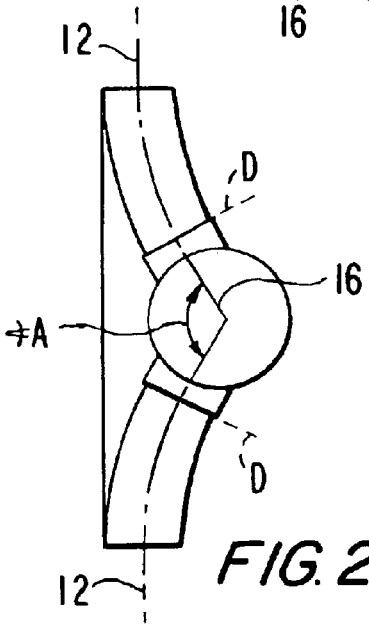
FIG. 2A shows the band of FIG. 2 attached to a wrist watch.
Figure 2:
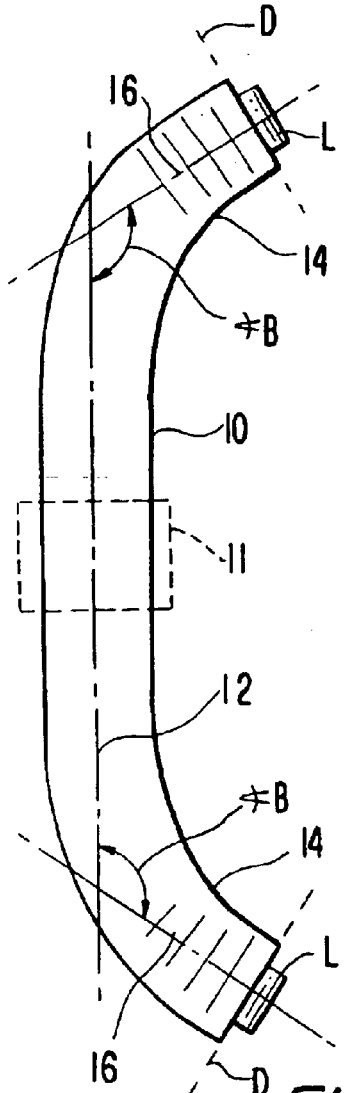
FIG. 2 shows a second embodiment of the invention.
Figure 4:
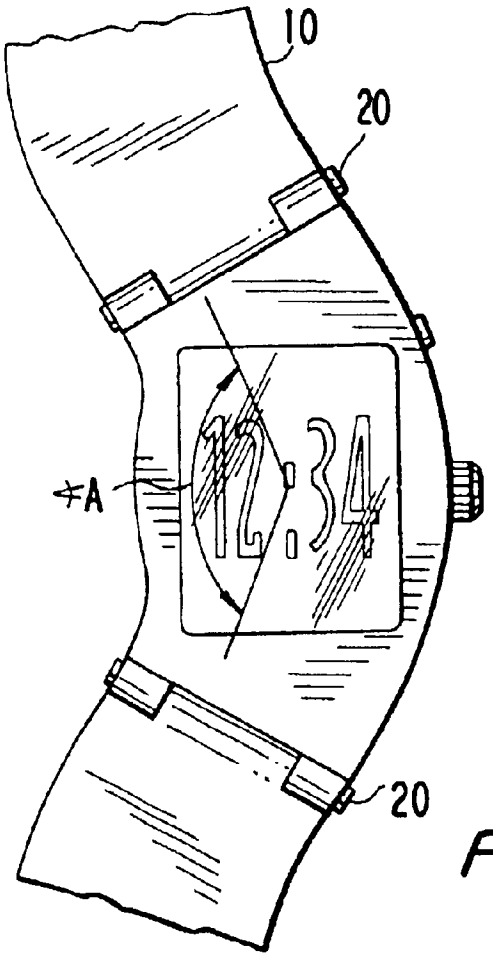
FIG. 4 shows the wrist band according to the second embodiment attached to a different watch.
Figure 3:
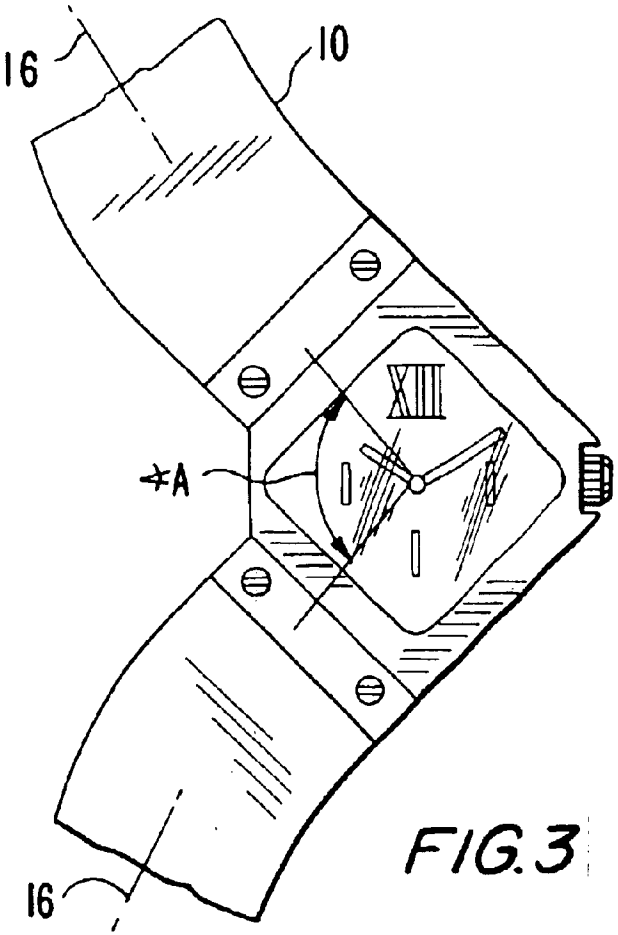
FIG. 3 shows the ends of the wrist band according to the first embodiment attached to a wrist watch.
Figure 5:
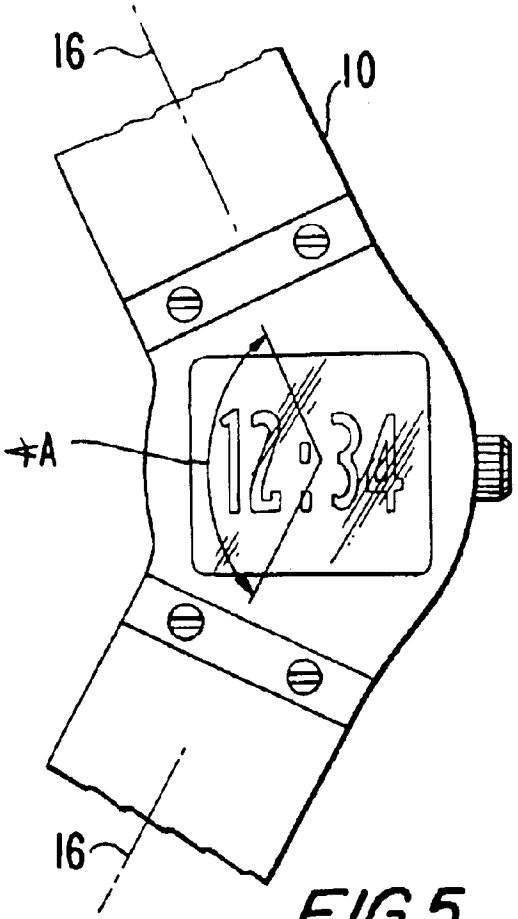
FIG. 5 shows another embodiment similar to the first embodiment attached to a watch.

With reference now to the drawings, FIGS. 1 and 2 show two embodiments of the wrist band according to the present invention. As shown, the wrist band comprises a band 10 having a major longitudinal axis 12 extending along substantially a major portion of the wrist band. At its ends 14, the wrist band turns at an angle. At the ends the wrist band has minor axes 16 as shown which form an angle B with the major axis 12 of the band. In the embodiment shown in FIG. 1, the wrist band attaches to, for example, a wrist watch or other object with screws 18. See FIGS. 3 and 5, for example, showing this attachment. In the embodiment shown in FIG. 2, the wrist band has a conventional loop portion L at the ends thereof through which a conventional hinge pin may be inserted. The hinge pin connects to hinge members 20, as shown, for example, in FIG. 4, which shows the wrist band attached to a wrist watch. Any other suitable connection means for connecting the ends of the band to the watch or other object can be employed.

In FIGS. 1 and 2, if the band is a two piece band, a buckle or clasp can be provided in known fashion to connect the other ends of the band together as shown schematically by dashed outline 11. Alternatively, a continuous type band can be employed, e.g., a flex band.

In each case, in both embodiments shown in FIG. 1 and 2, the wrist band may form D a straight line D at its end where it connects to the watch or other item to be held therebetween. The line D is substantially perpendicular to the minor axis 16. The line D can be curved or take some other shape at the attachment point to the watch or object. At the center of the attachment at the intersection with the minor axis 16, the intersection is substantially perpendicular. The included angle A between the intersecting minor axes 16, is less than 180°, as shown in FIGS. 2A, 3, 4 and 5, in contrast to known wrist bands wherein the band ends form an angle of 180° between the ends.

The invention has a number of advantages. When applied to a wrist watch, it allows the band to hide beneath the shirt sleeve of a long sleeve shirt, with the watch exposed to view. Additionally, because of the anatomical curvatures of the wrist, and in particular, at the wrist joint, due of the off center position of the watch or other item connected to the ends of the band, the watch or other item will resist the tendency to rotate around the wrist, thus keeping it in easy view. This is because the item that is held between the ends will tend to be held between or at the bony projections at the wrist joint.

Figure 6:
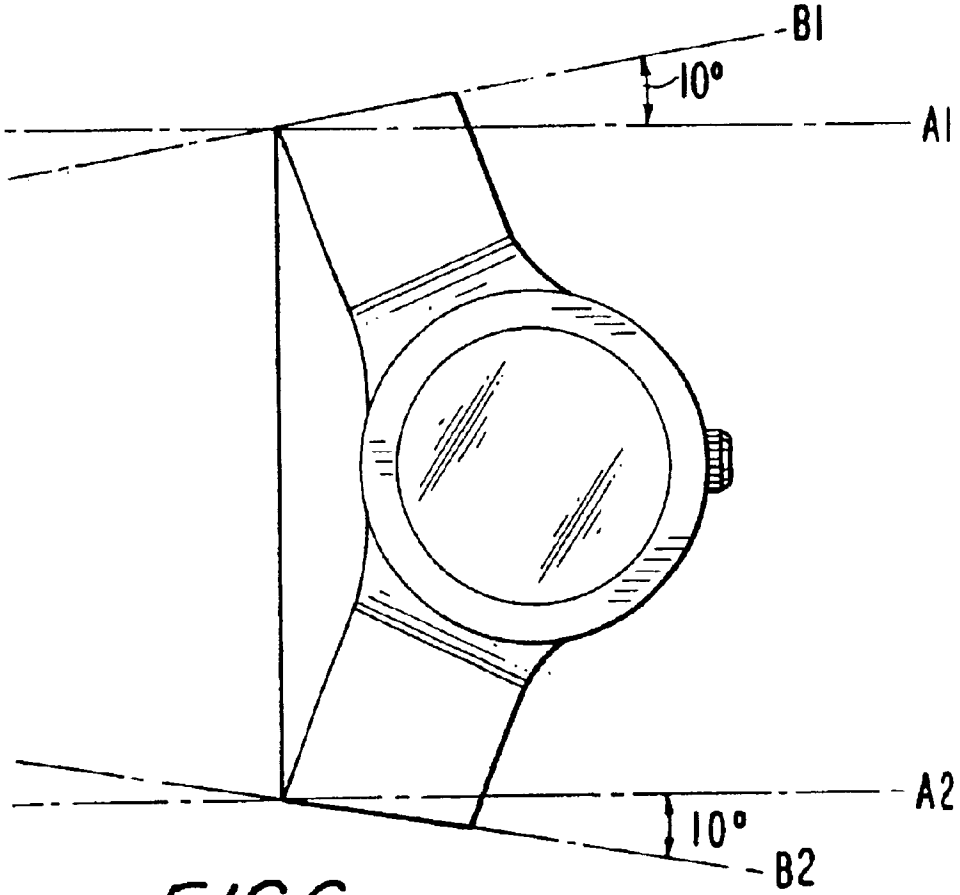
FIG. 6 shows a front view of a further embodiment of the invention.
Figure 7:
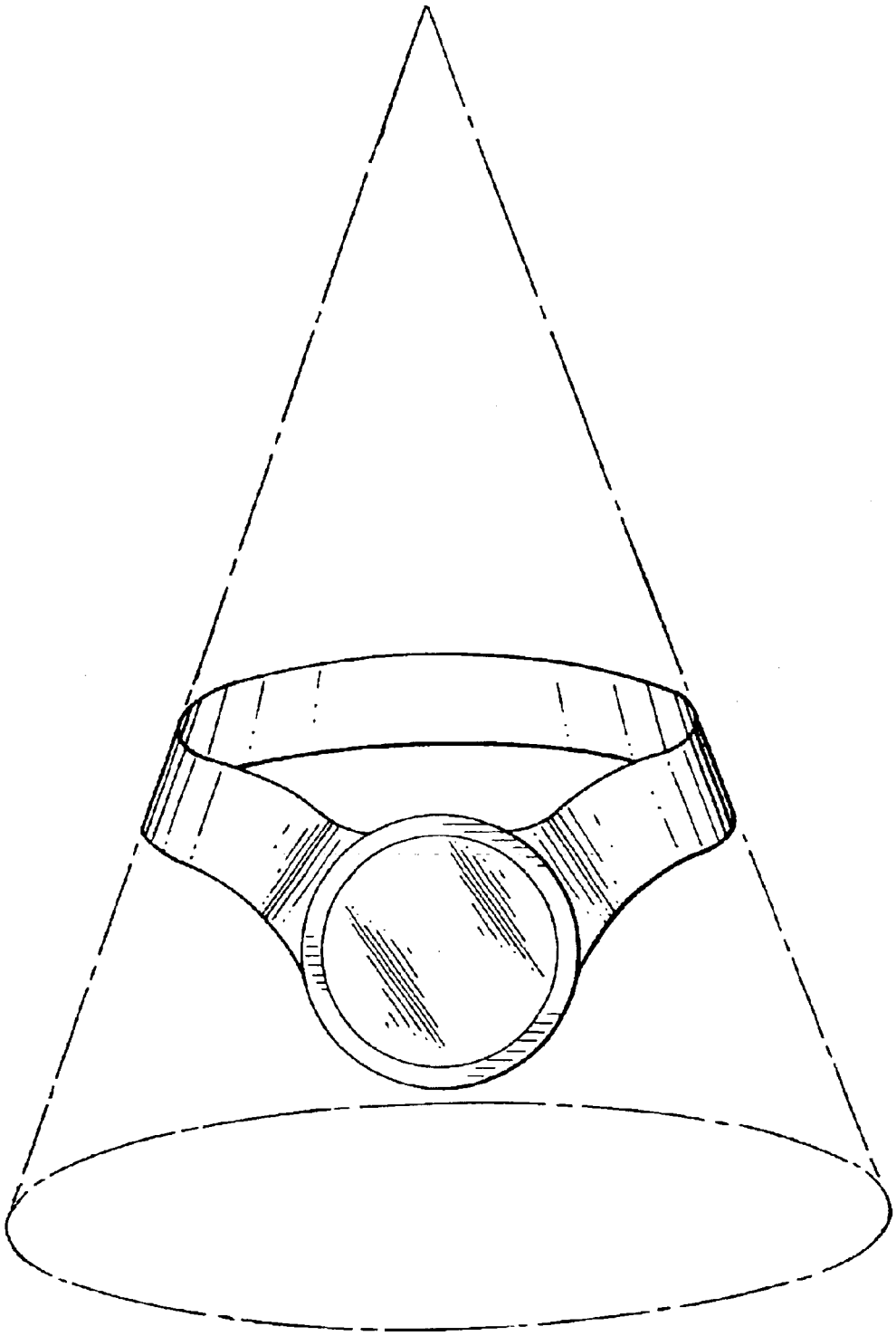
FIG. 7 shows the embodiment of FIG. 6 showing how it conforms to a conical shape to provide greater comfort.

FIGS. 6 and 7 show another embodiment of the invention. In FIG. 6, lines A1 and A2 are parallel to each other. Lines B1 and B2 are the edges of the band showing that the angles have been changed by, for example, 10 degrees on both sides. This feature shows that the band has one side wider than the other. The wider side would be worn towards the wearer's hand side. Anatomically, the human arm widens from the wrist to the hand. The wearer's hand is wider than the wrist and this area of the human body can be represented by a portion of a cone as shown in FIG. 7. The wrist band of this embodiment thus has a somewhat frusto-conical shape when assembled. This feature gives a better fit and more comfort by having the band shape conform anatomically to the wearer's wrist area. As in the other embodiments, the band can be a one piece or two piece band.

Although the present invention has been described in relation to particular embodiments thereof, many other variations and modifications and other uses will become apparent to those skilled bin the art. Therefore, the present invention should be limited not by the specific disclosure herein, but only by the appended claims.

What is claimed is:

1. A wrist band comprising a band for the wrist having a major longitudinal axis along a substantial portion of the length of the band and having two ends, the two ends each having a minor axis which is disposed at an angle to the major longitudinal axis, the ends further forming a substantially perpendicular intersection with the minor axes, the band being adapted to connect to an object to be attached between the ends to be worn at the wrist, whereby the angle between the minor axes at the ends is less than 180°.

2. The wrist band of claim 1, wherein the ends form straight lines perpendicular to the minor axes.

3. The wrist band of claim 1, wherein the object comprises a wrist watch.

4. The wrist band of claim 1, wherein the ends each form a loop for attachment to a hinge pin of the object.

5. The wrist band of claim 1, wherein the ends have screws for attachment to the object.

6. The wrist band of claim 1, wherein the band can be worn beneath a sleeve of a long sleeve shirt at the wrist of a wearer with the object exposed to view uncovered by the sleeve.

7. The wrist band of claim 1, wherein the band has two sides, one side being wider than the other side when the band is assembled and worn.

8. The wrist band of claim 7, wherein the band when worn has an approximately frusto-conical shape.

9. A wrist watch comprising a band for the wrist having a major longitudinal axis along a substantial portion of the length of the band and having two ends, the two ends each having an axis which is disposed at an angle to the longitudinal axis, the ends further forming a substantially perpendicular intersection with the minor axes, the band connecting to a timepiece between the ends to be worn at the wrist, whereby the angle between the minor axes at the ends is less than 180°.

10. The wrist watch of claim 9, where the ends form straight lines perpendicular to the minor axes.

11. The wrist watch of claim 9, wherein the ends each form a loop for attachment to a hinge pin of the timepiece.

12. The wrist watch of claim 9, wherein the ends have screws for attachment to the timepiece.

13. The wrist watch of claim 9, wherein the band can be worn beneath a sleeve of a long sleeve shirt at the wrist of a wearer with the timepiece exposed to view uncovered by the sleeve.

14. The wrist watch of claim 9, wherein the band has two sides, one side being wider than the other side when the band is assembled and worn.

15. The wrist watch of claim 7, wherein the band when worn has an approximately frusto-conical shape.

16. A wrist band comprising a band for the wrist, wherein the band, when assembled and worn, has an approximately frusto-conical shape, further wherein the band has a major longitudinal axis along a substantial portion of the length of the band and having two ends, the two ends each having a minor axis which is disposed at an angle to the major longitudinal axis, the ends further forming a substantially perpendicular intersection with the minor axes, the band being adapted to connect to an object to be attached between the ends to be worn at the wrist, whereby the angle between the minor axes at the ends is less than 180°.

17. A wrist watch comprising a band for the wrist and a timepiece, wherein the band, when assembled and worn has an approximately frusto conical shape further wherein the band has a major longitudinal axis along a substantial portion of the length of the band and having two ends, the two ends each having an axis which is disposed at an angle to the longitudinal axis, the ends further forming a substantially perpendicular intersection with the minor axes, the band connecting to the timepiece between the ends to be worn at the wrist, whereby the angle between the minor axes at the ends is less than 180°.

* * * * *